US005331758A

United States Patent [19]

Romick

[11] Patent Number: 5,331,758

[45] Date of Patent: Jul. 26, 1994

[54] SINGLE PIECE TRANSPARENT LABEL HOLDER

[76] Inventor: Jerome M. Romick, 170 N. Drexel Ave., Columbus, Ohio 43209

[21] Appl. No.: 727,975

[22] Filed: Jul. 10, 1991

[51] Int. Cl.[5] ..... G09F 3/20

[52] U.S. Cl. ..... 40/661; 40/668

[58] Field of Search ..... 40/661, 655, 668, 642; 132/315, 300; 24/487, 543

[56] References Cited

U.S. PATENT DOCUMENTS

| | | | |
|---|---|---|---|
| 465,697 | 12/1891 | Gray | 40/655 X |
| 707,546 | 8/1902 | Brooke | 40/642 X |
| 888,528 | 5/1908 | Phillips | 40/655 |
| 1,910,476 | 5/1933 | Rulong | 40/642 |
| 3,009,381 | 11/1961 | Rapata | 40/642 X |
| 3,432,954 | 3/1969 | Ford | 40/642 X |
| 3,461,876 | 8/1969 | Miller, Jr. | 24/543 X |
| 3,906,592 | 9/1975 | Sakasegawa | 24/487 X |
| 4,559,730 | 12/1985 | Burrell | 40/642 X |
| 4,887,335 | 12/1989 | Folkmar | 24/543 X |
| 4,964,526 | 10/1990 | Stephens | 132/315 |
| 5,078,159 | 1/1992 | Yuhara | 132/315 X |
| 5,092,354 | 3/1992 | Pacelli, Jr. | 132/315 X |

FOREIGN PATENT DOCUMENTS

| | | | |
|---|---|---|---|
| 3737 | 11/1908 | United Kingdom | 40/642 |

*Primary Examiner*—Kenneth J. Dorner
*Assistant Examiner*—J. Bonifanti
*Attorney, Agent, or Firm*—Wood, Herron & Evans

[57] ABSTRACT

A label holder made from a single piece of molded plastic with an area of reduced thickness (i.e., a living hinge) dividing the single piece into a back panel and a transparent front panel. The back panel has an area into which a label is placed. By applying finger pressure to the front panel, the holder can be closed along the living hinge until the front and back panels contact each other. Each locking tab on a panel interlocks with a corresponding free edge on the other panel and locking the label in a sandwiched condition. A release lip on the front panel facilitates unlocking and opening of the holder by similar finger pressure. The back panel has attachment means allowing easy insertion into any surface adapted with appropriate receiving means. Once connected, the holder is securely attached to the surface, while at the same time being easily removeable for quick and simple replacement.

9 Claims, 2 Drawing Sheets

SINGLE PIECE TRANSPARENT LABEL HOLDER

BACKGROUND OF THE INVENTION

This invention relates to label holders for use on drawers, doors, walls and the like. In particular, this invention relates to label holders used on the fronts of medication dispensing drawers or on the doors and walls of extended care facilities (i.e., nursing homes), hospitals and the like. However, it is understood that this invention has applications in other areas besides the health care industry.

Typical label holders have a picture frame-like structure which is permanently attached to or formed as an integral part of the outer front surface of such drawers. A label is usually inserted into such holders through either a slot along an outer edge of the frame or the label is flexed and inserted through the frame opening itself, with the information on the label being viewable through the picture frame opening. A drawback to this type of label holder has been that the surface of the label is not protected from such things as spilled liquid or contact with solid objects which could damage the label and obliterate the information thereon. The label could also be forced or fall out of the holder through the slot by brushing up against it or tipping the holder at an angle. This problem could be reduced by making the dimensions of the slot very close to the cross section of the label; however, the tighter the fit the more difficult it becomes to insert and remove the label. In addition, the label holding area in these type holders is not accessible to cleaning which can create an infectious control problem and a potential health hazard.

Clear plastic sheets have been inserted into the frame in front of the label in an effort to protect the label. This improvement provided protection from direct contact by solid objects and some protection against spilled liquids; however, a spilled liquid could not only enter the holder through the slot but also along the inside periphery of the frame. Seepage through the frame's inside periphery could be decreased by making the sheet and label fit tighter behind the frame. However, as previously discussed, the tighter the sheet and label fit behind the frame the more difficult it will be to insert and remove both, and the problem of inaccessibility to cleaning still remains.

In an attempt to protect the label, the frame type holder was modified by bonding the clear plastic sheet onto the frame in front of the label. Utilization of the cover sheet in this manner afforded additional protection against spilled liquids, except through the slot. However, with time the sheet becomes scuffed up or dirt accumulates behind it, due to its inaccessibility to cleaning, to the point of preventing a clear view of the label. In addition, the sheets often break off from the frame, leaving the user of the holder with little if any recourse because of the permanent nature of the holder.

Another holder, used to hold identification labels onto medication dispensing drawers, trays, shelves and the like, is formed from a single piece of transparent plastic which is extruded into a J shape, with the label being seated within the well formed by the J cross-section. This holder is typically glued to the subject surface. Such label holders exhibit the same type of problems as previously discussed.

Still another label holder, typically used to hold personnel identification cards, is formed from a single sheet of transparent plastic folded at two points along its length and closable like a matchbook cover, with attachment by means such as an open loop/pin combination. While this holder can tend to sandwich the subject label within the folded plastic sheet, there is still little protection from spilled liquids entering through the open sides and there is no structural means for preventing the label from falling out of either open side of the holder.

SUMMARY OF THE INVENTION

It is an object of the present invention to provide a label holder which facilitates easy insertion and removal of a label while at the same time effectively locking the label within the holder and providing more protection against spilled liquids than previously found in the prior art.

Another object of the present invention is to provide a label holder which is readily replaceable while at the same time being securely attached to the subject surface.

Another object of the present invention is to provide a label holder which can securely hold in place not only a label of comparable dimensions to the holder but also labels of smaller size and variable structural stiffness.

The above objects of the invention are attained by providing a holder made from a single piece of molded plastic with an area of reduced thickness (i.e., a living hinge) dividing the single piece into a back panel and a transparent front panel. Locking tabs lock the back and front panel together in the closed condition. One feature of the invention is a release lip which aids in unlocking and opening the holder.

Another feature of the invention resides in the structure for encapsulating the label between the back and front panel. In one embodiment a depression is formed in the face of the back panel, and a raised area is formed on the rear of the front panel. This raised area fits within the depression when the label holder is in the closed and locked position.

In another embodiment, a ridge is formed on the face of the back panel and is positioned so as to border the free edges of the front panel when the holder is in the closed and locked position.

Another feature of the invention resides in the structure for attaching the holder to a surface such as the face of a drawer, a door or a wall. In one embodiment, spaced apart locking prongs project out from the rear of the back panel. These prongs interlock with matching receptacles found on the attaching surface.

In another embodiment, the side edges of the back panel are further apart then those of the front panel to a sufficient degree to allow the back panel's edges to be held between the attaching surface and two spaced apart vertical flanges which project out from the surface and form slots for receiving the side edges of the back panel. The lateral edges of the back panel can be slid down into and held by the slots formed between each flange and the attaching surface.

Another feature of the invention resides in the retaining lip located on the back panel and underlying a rib which projects out from the attaching surface. This lip helps secure the back panel to the attaching surface against the resistance of the locking tabs as the front panel is pulled away from the back panel.

After placing the label on the back panel, the holder can be easily closed by the simple application of finger pressure to bend the front panel, along the living hinge, toward the back panel until the front panel has seated above and interlocked with the back panel. In the closed state, a label is locked within the holder and effectively protected from such things as spilled liquids and contact with solid objects. The holder is easily opened by applying upward finger pressure to the release lip. The holder is easily inserted, by the application of finger pressure, into any surface adapted for receiving the particular holder attachment means. Once inserted, the holder is securely attached to the surface, while at the same time being easily removeable for quick and simple replacement.

The present invention will become more readily apparent from the following detailed description taken in conjunction with the accompanying drawings in which:

DETAILED DESCRIPTION OF THE INVENTION

Figure 1:
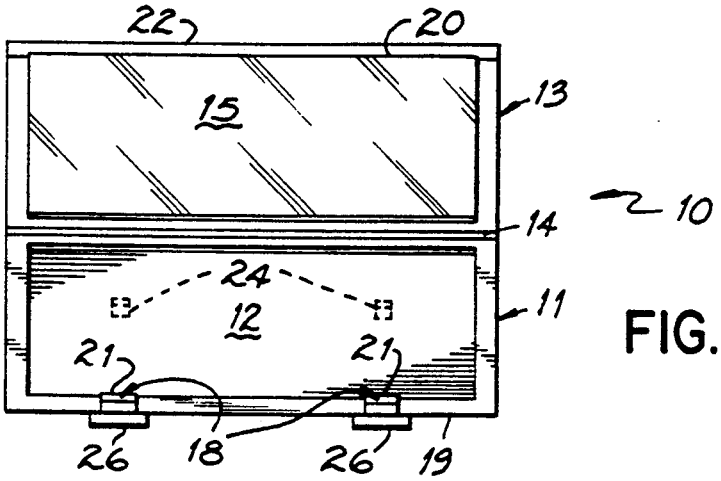
FIG. 1 is a front elevated view of a fully opened label holder.
Figure 2:
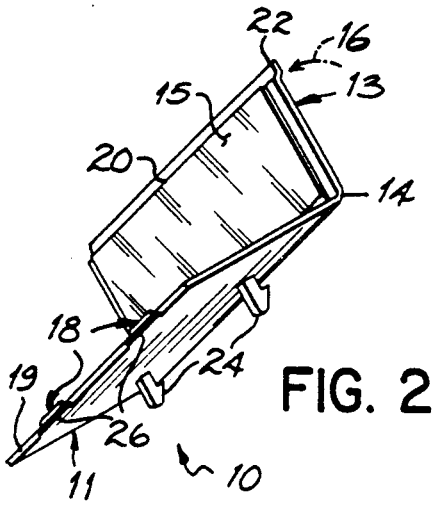
FIG. 2 is a perspective view of the partially closed label holder of FIG. 1.

Referring to FIGS. 1–4, a representative label holder 10 has a first or back panel 11 with a depressed area 12 on the face of the back panel 11, for receiving a label (not shown). A second or front panel 13 is connected to the back panel 11 along adjoining edges by a living hinge 14. A raised area or boss 15 is located on the rear of the front panel 13. The boss 15 is dimensioned to fit within the depression 12 when the label holder 10 is in the locked condition (see FIG. 3). The boss 15 at least partially fills the depression 12 to a desired depth leaving a sufficient cavity to accommodate the thickness of a label.

Figure 3:
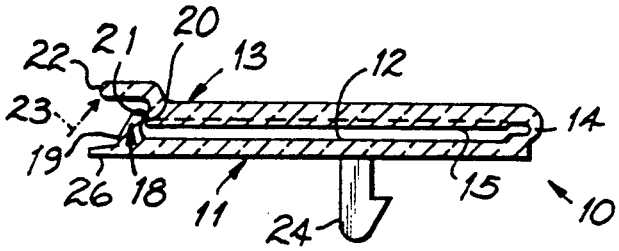
FIG. 3 is a side cross sectional view of the fully closed label holder of FIG. 1.
Figure 4:
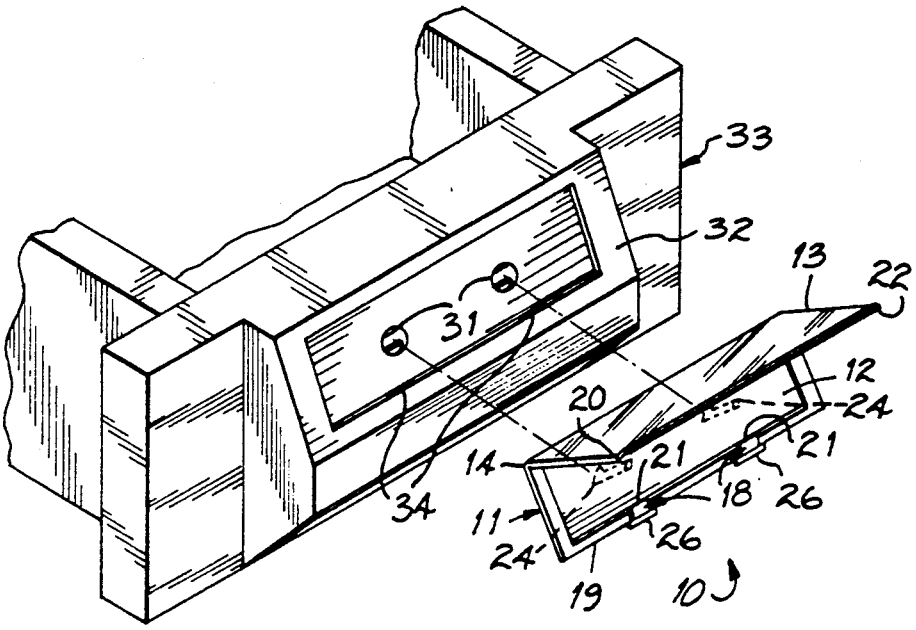
FIG. 4 is a perspective view of the label holder of FIG. 1 about to be attached to a drawer.

Two spaced apart locking protuberances or tabs 18, located along a first or lower edge 19 of the back panel 11, engage and interlock with a second or upper locking edge 20 of the front panel 13 when the holder 10 is in the fully closed and locked condition, as shown in FIG. 3. Each locking tab 18 has a leading edge 21.

A release lip 22 is located along and running the length of the upper edge 20 of the front panel 13. The release lip 22 projects initially outward from the face of the front panel 13 and then curves away from the living hinge 14. The lip 22 is used to facilitate unlocking and opening of the holder 10.

Two spaced apart locking prongs 24 project perpendicularly out from the rear of the back panel 11. These prongs 24 engage and interlock with corresponding holes 31 (see FIG. 4) located on, for example, the front 32 of a drawer 33. Two spaced apart retaining lips 26 project out from the lower edge 19 of and are coplanar with the back panel 11 and in line with the locking tabs 18 and prongs 24. The retaining lips 26 aid in securing the holder 10 to a surface such as the front 32 of a drawer 33 by engaging corresponding retaining slots 34.

A label (not shown) is locked and sealed within a holder 10 by first placing the label within the depression 12. By applying finger pressure to the face of the front panel 13 (see the ghost arrow 16 in FIG. 2), the front panel 13 can be swung, along the living hinge 14, toward the back panel 11 until the rear of the front panel 13 comes in contact with the face of the back panel 11. In locking the label holder 10 closed, the upper edge 20 of the front panel 13 makes contact with and is forced past the leading edge 21 of the locking tabs 18, causing the tabs 18 to deflect. The holder 10 is unlocked by applying finger pressure up under the release lip 22 (see the ghost arrow 23 in FIG. 3) until the upper edge 20 of the front panel 13 is pulled up passed the leading edge 21 of the locking tabs 18. The holder can be fully opened by continuing to apply this upward pressure.

Figure 7:
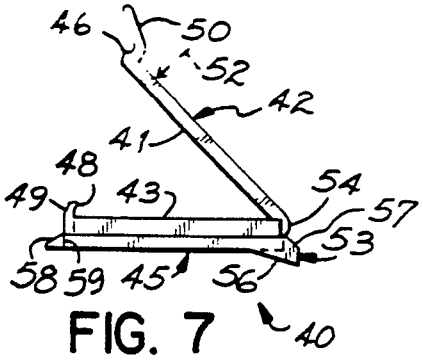
FIG. 7 is a side view of the partially closed label holder of FIG. 5.
Figure 8:
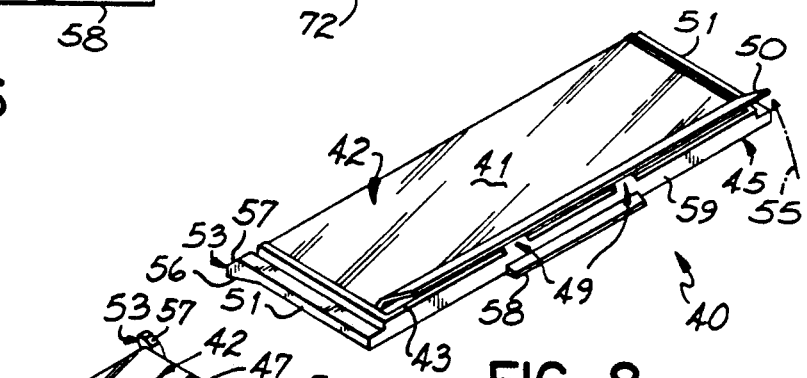
FIG. 8 is a perspective view of the fully closed label holder of FIG. 5.

In an alternative embodiment holder 40, as illustrated by FIGS. 5–9, instead of a boss 15 fitting into a depression 12, the holder 40 of this embodiment is in the locked position when the entire rear surface 41 of the front panel 42 seats within the confines of a continuous integral rib 43. The integral rib, which serves to locate and confine the label (not shown), projects out from the face 44 of the back panel 45 and borders the upper 46 and side 47 edges of the front panel 42 when the holder 40 is in the locked position, as shown in FIG. 8. The label holder 40 can be locked and unlocked in the same manner as the previous embodiment. Locking occurs when the upper edge 46 of the front panel 42 is forced past the leading edge 48 of the locking tabs 49 by the application of finger pressure in the direction shown by the ghost arrow 52 of FIG. 7. Unlocking occurs by applying similar finger pressure (see the ghost arrow 55 in FIG. 8) up under the release lip 50 until the upper edge 46 of the front panel 42 is pulled up past the leading edge 48 of the locking tabs 49.

Figure 9:
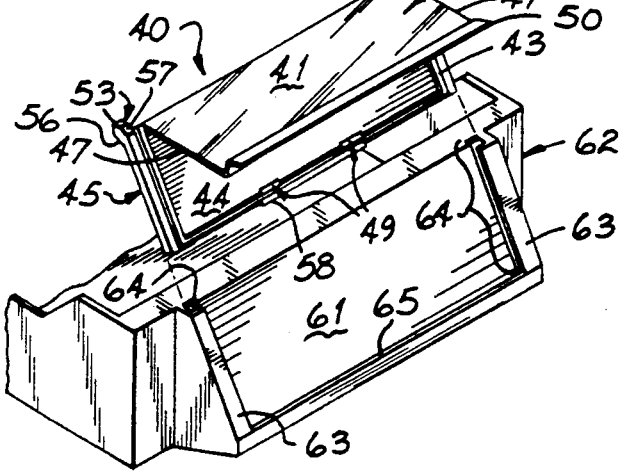
FIG. 9 is a perspective view of the label holder of FIG. 5 about to be attached to a drawer.

Side edges 51 of the back panel 45 stick out beyond the corresponding lengths of integral rib 43 to a sufficient degree to allow the side edges 51 to pass between the outer surface 61 of, for example, a drawer 62 and two spaced apart vertical flanges 63 projecting outwardly from said outer surface 61 (see FIG. 9). Each of said side edges 51 has a retaining barb 53 located on the upper corner which projects outwardly from the rear of the back panel 45 and from the hinged edge 54. Each side edge 51 engages and interlocks with an opening 64 located adjacent to each vertical flange 63. Each retaining barb 53 has a cam surface 56 which aids in the full insertion of each side edge 51 into each vertical flange 63 and a beveled surface 57 for interlocking with opening 64. A retaining lip 58 projects out from the lower edge 59 of and is coplanar with the back panel 45. The retaining lip 58 aids in securing the holder 40 to the surface 61 by underlying the rib 65 when each barb 53 has engaged and interlocked with an opening 64.

Figure 5:
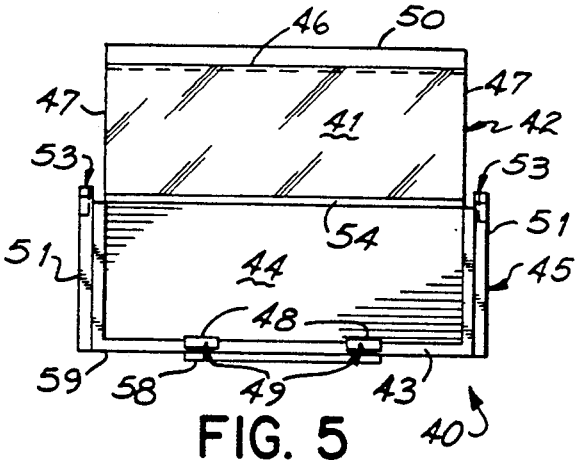
FIG. 5 is a front elevated view of a fully opened label hold/showing an alternative embodiment.
Figure 6:
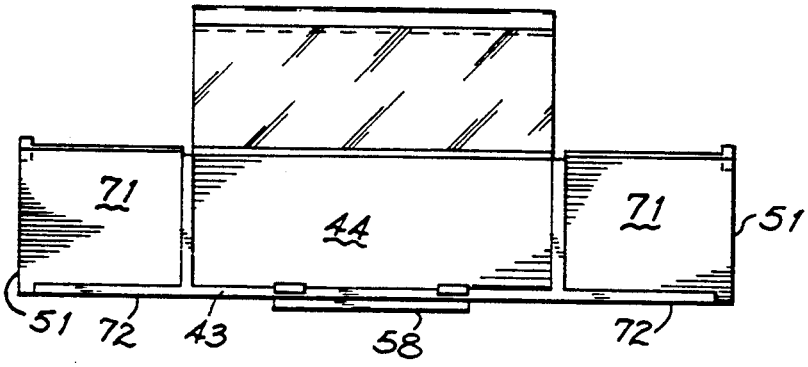
FIG. 6 is a front elevated view of a fully opened modification of the label holder of FIG. 5.

A modification to the embodiment of FIGS. 5, 7 and 8 is illustrated in FIG. 6. Instead of being in close proximity to the corresponding lengths of integral rib 43, the back panel side edges 51 are each separated from this rib length by an extension wing 71. In addition, integral rib 43 extends along the lower edge 72 of each wing 71. Thus, the back panel face 44 which receives the label (not shown) can be a smaller area than the outer surface 61 of the drawer 62 (see FIG. 9).

The label holders illustrated in FIGS. 1–9, are exemplary of a wide variety of holder configurations that can be created using the basic concepts of the present invention.

From the above disclosure of the general principles of the present invention and the preceding detailed description, those skilled in the art will readily comprehend the various modifications to which the present invention is susceptible. Therefore, we desire to be limited only by the scope of the following claims and equivalents thereof:

I claim:

1. A label holder, comprising:

a first panel and a second panel, said panels being connected along adjoining edges by a hinge, one of said panels having a transparent portion, one of said panels having a first edge and the other of said panels having an outer periphery and a second edge defining part of said outer periphery, one of said panels having a depressed area formed therein and the other of said panels having a raised area formed thereon, said raised area at least partially fitting within said depressed area to form a cavity for a label when said holder is in a closed and locked condition, and at least one locking protuberance located along said first edge and having a leading edge, said second edge being adjacent to said leading edge and in contact with said at least one locking protuberance when said holder is in the closed and locked condition, wherein in order to close and lock said holder and secure a label therewithin, one of said panels is swung along said hinge toward the other of said panels until said second edge makes contact with and is forced past said leading edge, thereby deflecting said at least one locking protuberance, the label being sandwiched between said panels.

2. The label holder of claim 1 wherein one of said panels is a front panel and the other of said panels is a back panel and said label holder further comprises:

a realease lip located adjacent to said second edge and projecting outwardly from said fron panel, whereby to unlock and open said holder from said closed and locked condition, said panels are separated by applying a pulling pressure to said release lip until said second edge is forced past the leading edge of said at least one locking protuberance.

3. The label holder of claim 2 wherein said release lip is located adjacent to, initially curves out from and eventually generally parallels said front panel.

4. The label holder of claim 1 in combination with a surface having means for retaining said label holder, wherein said panels define between them a receptacle for securing a label when said holder is in said closed and locked condition.

5. The combination of claim 4 wherein said holder is of one piece construction, one of said panels has at least one locking prong integrally formed as a continuous part thereof, and the means on said surface for retaining said label holder includes at least one hole formed in said surface for receiving said at least one locking prong, thereby forming a secure connection between said surface and said label holder.

6. The label holder of claim 1 wherein said first panel has said first edge and two locking protuberances are spaced apart along said first edge and curve out from said first panel towards said hinge.

7. The label holder of claim 1 wherein one of said panels is a back panel and said label holder further comprises at least one retaining lip projecting out from said back panel.

8. A label holder, comprising:

a back panel and a front panel hinged along adjacent edges, said front panel having a transparent portion and each of said panels having a locking edge, a face, and a rear surface, a release lip located adjacent to the locking edge of said front panel, said release lip and the locking edge of said front panel forming a channel therebetween, a depressed area located on the face of said back panel, a raised area located on the rear surface of said front panel and dimensioned to fit within said depressed area and form a sufficiently sized cavity to accommodate a label when said holder is in a closed and locked condition, at least one locking protuberance, located along the locking edge of, projecting above the face of, curving towards the hinged adjacent edge of said back panel, and having a leading edge, the locking edge of said front panel being adjacent to said leading edge and in contact with said at least one locking protuberance when said label holder is in the closed and locked condition, at least one locking prong projecting out from the rear surface of and integrally formed as a continuous part of said back panel, and at least one retaining lip projecting from said back panel.

9. A label holder in combination with a surface having means for retaining said label holder, said combination comprising:

a first panel and a second panel, said panels being connected along adjoining edges by a hinge, one of said panels having a transparent portion, one of said panels having a first edge and the other of said panels having an outer periphery and a second edge defining part of said outer periphery, one of said panels having at least one locking prong integrally formed as a continuous part thereof, at least one locking protuberance located along said first edge and having a leading edge, said second edge being adjacent to said leading edge and in contact with said at least one locking protuberance when said holder is in a closed and locked condition, and the means on said surface for retaining said label holder includes at least one hole formed in said surface for receiving said at least one locking prong, thereby forming a secure connection between said surface and said label holder, wherein in order to close and lock said holder and secure a label therewithin, one of said panels is swung along said hinge toward the other of said panels until said second edge makes contact with and is forced past said leading edge, therby deflecting said at least one locking protuberance, said panels defining between them a receptacle for securing a label when said holder is in the closed and locked condition.

* * * * *